US010986884B2

(12) United States Patent
Cox

(10) Patent No.: US 10,986,884 B2
(45) Date of Patent: Apr. 27, 2021

(54) PROTECTIVE SPORTS GUARD

(71) Applicant: Michael G. Cox, Felton, PA (US)

(72) Inventor: Michael G. Cox, Felton, PA (US)

(73) Assignee: WM. T. BURNETT IP, LLC, Baltimore, MD (US)

( * ) Notice: Subject to any disclaimer, the term of this patent is extended or adjusted under 35 U.S.C. 154(b) by 191 days.

(21) Appl. No.: 16/272,741

(22) Filed: Feb. 11, 2019

(65) Prior Publication Data

US 2019/0246710 A1 Aug. 15, 2019

Related U.S. Application Data

(63) Continuation of application No. 14/924,472, filed on Oct. 27, 2015, now Pat. No. 10,201,196.

(60) Provisional application No. 62/068,813, filed on Oct. 27, 2014.

(51) Int. Cl.

| | |
|---|---|
| ***A41D 13/05*** | (2006.01) |
| ***A63B 71/12*** | (2006.01) |
| *A63B 43/00* | (2006.01) |

(52) U.S. Cl.

CPC ..... *A41D 13/0568* (2013.01); *A63B 71/1225* (2013.01); *A63B 43/005* (2013.01); *A63B 2071/125* (2013.01); *A63B 2071/1258* (2013.01)

(58) Field of Classification Search

CPC ..... A41D 13/0568; A41D 13/08; A63B 71/1225; A63B 2071/125; A63B 2071/1258; A41B 43/005

See application file for complete search history.

(56) References Cited

U.S. PATENT DOCUMENTS

| | | | | | |
|---|---|---|---|---|---|
| 4,370,978 | A * | 2/1983 | Palumbo | A61F 13/062 | 602/26 |
| 4,497,070 | A * | 2/1985 | Cho | A43B 5/00 | 2/22 |
| 4,914,753 | A * | 4/1990 | Chang | A41D 13/0568 | 2/24 |
| 5,107,823 | A * | 4/1992 | Fratesi | A41D 13/0568 | 2/22 |
| 5,301,370 | A * | 4/1994 | Henson | A63B 71/1225 | 2/22 |
| 5,452,475 | A * | 9/1995 | Hunt, Jr. | A63B 71/1225 | 2/22 |
| 5,561,857 | A * | 10/1996 | Hoshizaki | A63B 71/1225 | 2/22 |
| 5,594,954 | A * | 1/1997 | Huang | A41D 13/065 | 2/16 |

(Continued)

*Primary Examiner* — Khaled Annis

(74) *Attorney, Agent, or Firm* — Royal W. Craig; Gordon Feinblatt LLC

(57) ABSTRACT

A protective sports guard can include a lower component that includes a hard shell outer layer attached atop a flexible padding layer; an upper component that includes a hard shell outer layer attached atop a flexible padding layer; a central component attached to and straddling the lower component and the upper component and that includes a hard shell outer layer; and an elongate strap. The elongate strap can be fixedly attached at one end to the flexible padding layer of the lower component, releasably and variably attached at another end to itself, and configured to wrap around the lower component in excess of one full revolution and to envelop and compress a human body part for a compression fit.

16 Claims, 7 Drawing Sheets

(56) References Cited

U.S. PATENT DOCUMENTS 5,611,080 A * 3/1997 Skottheim ..... A41D 13/0568 2/16
5,671,478 A * 9/1997 Yen ..... A63B 71/12 2/22
5,688,038 A * 11/1997 Chien ..... A41D 13/01 362/103
5,732,411 A * 3/1998 Coleman ..... A63B 71/1225 2/22
5,829,055 A * 11/1998 Collins ..... A63B 71/1225 2/22
5,920,901 A * 7/1999 Tollini ..... A44B 18/00 2/22
6,058,504 A * 5/2000 Tollini ..... A63B 71/1225 2/22
6,178,556 B1 * 1/2001 Foreman ..... A63B 71/08 128/882
6,205,583 B1 * 3/2001 Beland ..... A41D 13/0568 128/881
8,510,862 B1 * 8/2013 Contant ..... A63B 71/1225 2/22
9,149,709 B1 * 10/2015 Schuster ..... A63B 71/081
2003/0154540 A1 * 8/2003 Nishimoto ..... A63B 71/1225 2/220
2005/0114976 A1 * 6/2005 Beland ..... A63B 71/1225 2/22
2005/0246812 A1 * 11/2005 Bevier ..... A63B 71/1225 2/22
2006/0041986 A1 * 3/2006 Godshaw ..... A41D 13/065 2/24
2006/0096000 A1 * 5/2006 Romero ..... A41D 13/065 2/22
2006/0107433 A1 * 5/2006 Olson ..... A63B 71/08 2/22
2009/0077703 A1 * 3/2009 Gabry ..... A41D 13/05 2/16
2010/0192269 A1 * 8/2010 Saranga ..... A41D 13/0543 2/24
2012/0096615 A1 * 4/2012 Fisher ..... A63B 71/1225 2/22
2013/0012855 A1 * 1/2013 Giza ..... A61F 5/0111 602/27
2014/0359912 A1 * 12/2014 Sutton ..... A41D 13/015 2/16
2015/0033433 A1 * 2/2015 Mackey ..... A63B 69/0026 2/22
2015/0264987 A1 * 9/2015 Morin ..... A41D 13/0568 2/16
2016/0192714 A1 * 7/2016 Williams ..... A41B 9/12 2/455
2017/0006929 A1 * 1/2017 Bourgeois ..... A41D 13/065
2018/0326290 A1 * 11/2018 Rodrick ..... A41D 13/0153
2019/0351310 A1 * 11/2019 Lovetro ..... A63B 1/00

* cited by examiner

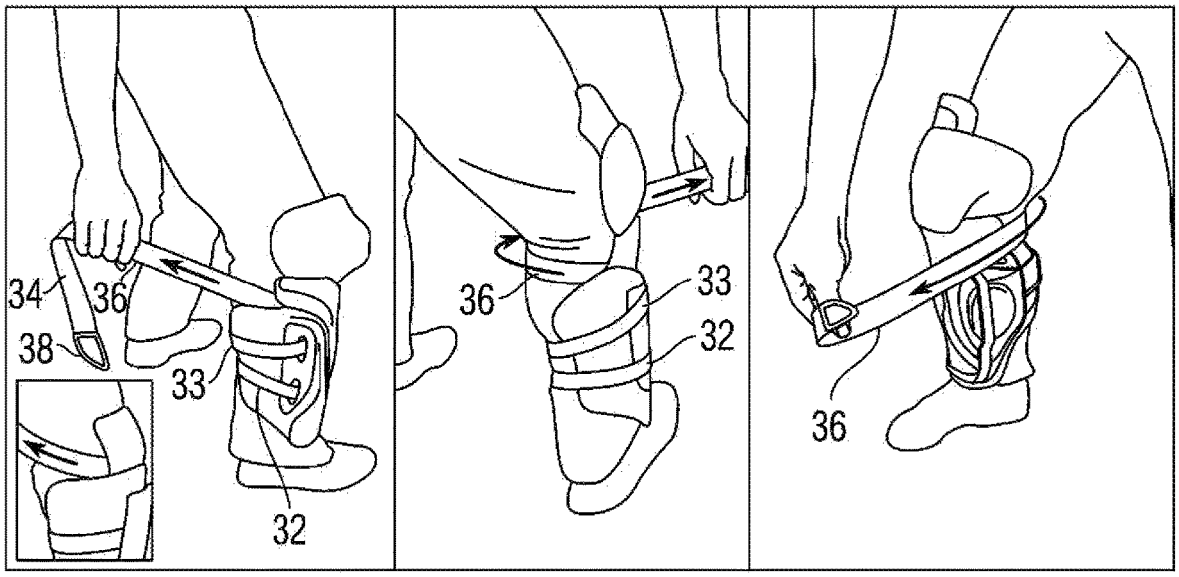

Pull strap back and wrap around top of calf.

Pull tight on strap.

Continue from back to inside calf and around to front of shinguard.

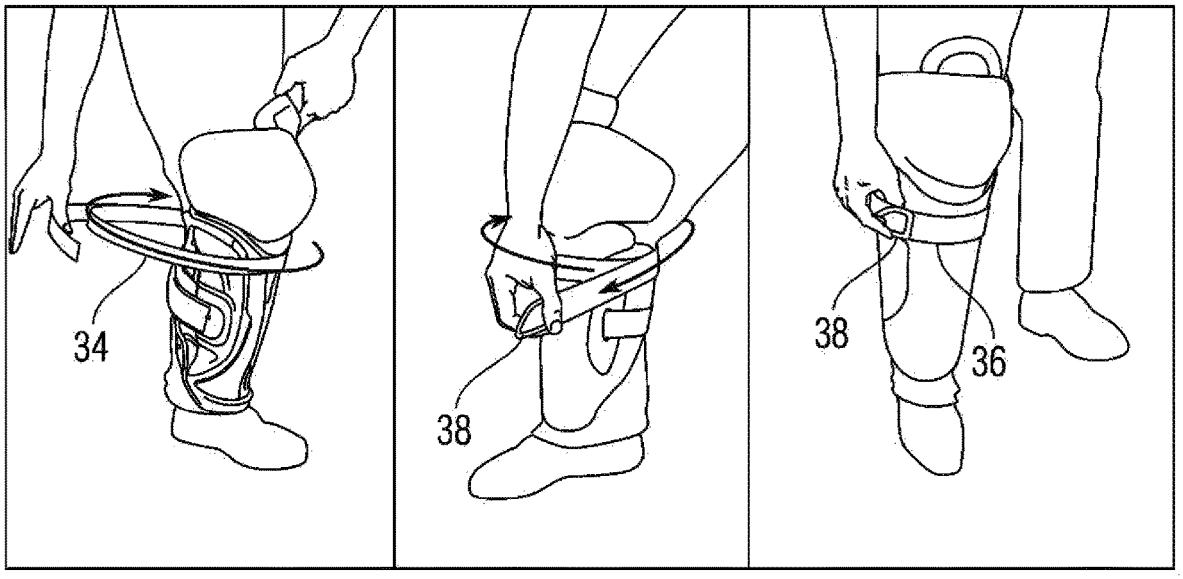

Continue around front of shin and back onto start of strap. This has made a 360° rotation. *Note you must wrap strap more then 360 degrees around leg in order to attach hook to strap proper hold.

Once again continue around back of calf and inside calf. Fit to comfortable tension.

Land the hook tab onto strap at a comfortable tension towards inside of leg or front of shin. This has made a 360+ rotation.

FIG. 7

PROTECTIVE SPORTS GUARD

CROSS-REFERENCE TO R ELATED APPLICATION(S)

The present application is a continuation of U.S. patent application Ser. No. 14/924,472 filed on Oct. 27, 2015 which is incorporated herein by reference. U.S. patent application Ser. No. 14/924,472 in turn derives priority from U.S. Provisional Patent Application 62/068,813 filed 27 Oct. 2014.

BACKGROUND OF THE INVENTION

1. Field of the Invention

The present invention relates generally to protective sports equipment and, in particular, an arm, shin or other type of guard that provides improved flexibility and fit without compromising protection.

2. Description of the Background

Protective sports equipment is commonly used and, indeed, is often required to be used in many organized sports such as lacrosse, hockey, and other contact sports. For example, shin guards are common precautions against painful contusions to the lower leg when the shin is kicked by another player or is struck by a puck or ball. Conventional shin guards are typically fabric-encased rubber pads or rigid plates, with elasticized fabric straps that wrap around the leg. Even with gaps or breaks between the protective pads to allow for flexibility, there is a limitation to how far adjacent pads can move relative to each other and still maintain adequate protection of a player. When such shin guards undergo deformation due to normal use by a wearer, adjacent pads come into contact with each other and this arrests/resists further motion. In addition, the inflexibility of the fabric layers and liner resist stretching and further arrests/resists motion. Thus, these shin guards are still fairly rigid in design and compromise flexibility for protection. In straining against these forces a player loses dexterity and burns tremendous energy. In addition, these conventional shin guards tend to slip downward toward the ankle, or rotate backward on the leg during play. As a result they tend to require frequent repositioning and/or adjustment to prevent irritation to the ankle. If no break in the action were to occur, the player would suffer with the misplaced shin guard until the play stopped. Other types of guards such as arm guards suffer in the same respects.

Shin guards with integral socks are also known. With these, a rigid plate is essentially built into a sock and often includes a stirrup that extends underneath the foot. These straps and stirrups help to maintain the position of the shin guard. However, the increase in positioning stability often results in losing degrees of freedom of movement of the shin and calf, as the straps and rigid construction of the plate of the shin guard inhibit the movements of the leg, particularly the flexing of the muscles of the calf. Such restriction of movement of the calf muscles is particularly problematic in a sport like hockey, where quick-cutting agility is required.

Some attempts have been made to provide guards that protect while maximizing the flexing capabilities of the muscles and joints guarded. These designs however typically include removing portions of the protecting rigid plates to reduce the stiffness of the guards or hinging the rigid plates, neither of which accomplishes the goal of protection and flexibility. Therefore, a need remains for a sports guard capable of protecting adequately while providing improved flexibility characteristics.

What is needed then is a protective sports guard that provides improved flexibility, increased protection, and a better fit that will not shift or come loose during play.

SUMMARY OF THE INVENTION

One object of the present invention is to provide a sports guard with improved protection against impacts, for example, a shin guard that protects the shin and knee from impacts.

Another object is to accomplish the above-described enhanced level of protection without compromising flexibility, allowing unobstructed forward flex and mobility of leg for "natural" motion.

In one aspect, a protective shin guard includes a floating knee section attached to a shin section, both sections being formed of multiple layers including a hard shell outer layer with multiple articulated panels attached atop a padding layer formed of one or more blocking panels of compressible foam (e.g., high-density microcellular polyurethane foam), plus a soft foam pad or woven fabric underlayment against the skin. The hard shell outer layer of the shin section include a central Y-shaped shin bone panel and two flanking side leg panels. In one embodiment, the shin bone panel and flanking side leg panels are integrally-formed and nearly fully separated by a notch, except at bridge areas of reduced material thickness which effectively form living hinges that allow the side panels to rotate and move with respect to the shin bone panel. A pair of living hinges bridges each side panel of the shin guard to the shin bone panel. The shin guard is attached to the leg by a single 360 degree compression strap that wraps fully around the leg and works in conjunction with the side panels to pull them in from all sides, offering a more comfortable yet secure compression fit.

In another aspect, a protective shin guard includes a floating knee section attached to a shin section, both sections again being formed of a hard shell outer layer with multiple articulated panels attached atop a padding layer formed of one or more foam blocking panels, plus a soft foam pad or woven fabric underlayment against the skin. In this embodiment multiple hard shell outer panels are seated within the foam padding layer, the latter forming a flexible framework within which the hard shell outer panels may be seated flush. A soft foam pad or woven fabric liner serves as an underlayment against the skin. The hard shell outer panels are shaped to accommodate and fit with the separate, less rigid foam framework which serves to break the rigid outer shell so that the shin guard will flex horizontally and, when tightened with the same 360 degree compression strap described above, fit snuggly around a user's leg.

The hard shell outer panels of the shin section include a central shin hone panel and flanking side leg panels. In this second embodiment, the shin bone panel and flanking side leg panels are separately-formed, separated by a notch, and joined by pliable inserts which effectively form flexible hinges, allowing the side panels to rotate and move with respect to the shin bone panel, but also control and/or transform the flexing of side leg panels. Again, the shin guard is attached to the leg by a single 360+ degree compression strap that wraps fully around the leg and works in conjunction with the side panels to pull them in from all sides, offering a more comfortable yet secure fit. In both embodiments the 360+ compression strap combined with the hard/soft padding layers and flexible hinges or inserts provides maximum protection to the user's shin and knee while maintaining as much flexibility as possible.

In yet another aspect, a protective sports guard can include a lower component that includes a hard shell outer layer attached atop a flexible padding layer; an upper component that includes a hard shell outer layer attached atop a flexible padding layer; a central component attached to and straddling the lower component and the upper component and that includes a hard shell outer layer; and an elongate strap. The elongate strap can be fixedly attached at one end to the flexible padding layer of the lower component, releasably and variably attached at another end to itself, and configured to wrap around the lower component in excess of one full revolution and to envelop and compress a human body part for a compression fit.

The present invention is described in greater detail in the detailed description of the invention, and the appended drawings. Additional features and advantages of the invention will be set forth in the description that follows, will be apparent from the description, or may be learned by practicing the invention.

BRIEF DESCRIPTION OF THE DRAWINGS

Other objects, features, and advantages of the present invention will become more apparent from the following detailed description of the preferred embodiments and certain modifications thereof when taken together with the accompanying drawings in which:

FIG. 7 is a composite step-by-step illustration of the process for affixing the shin guards 2, 20 to the leg using the 360+ degree strap system.

DETAILED DESCRIPTION OF THE PREFERRED EMBODIMENT

Figure 1:
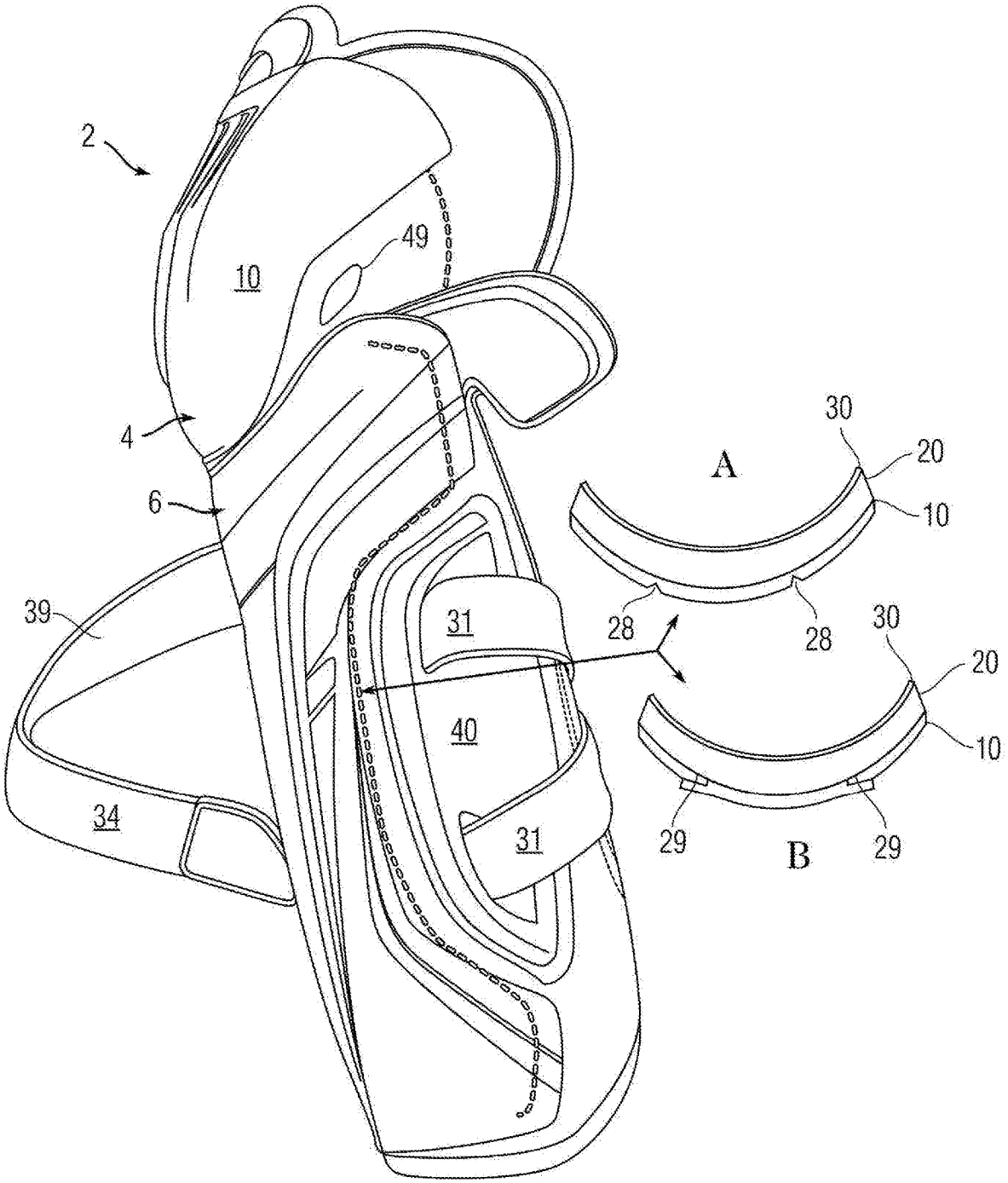
FIG. 1 is a right-side perspective illustration of a protective shin guard 2 in accordance with a first embodiment of the present invention.

Reference will now be made in detail to preferred embodiments of the present invention, examples of which are illustrated in the accompanying drawings. Wherever possible, the same reference numbers will be used throughout the drawings to refer to the same or like parts.

The embodiments of the present invention described herein all regard a protective sports guard that employs a particular flex-padding configuration formed of multiple layers including a hard shell outer layer with multiple articulated panels attached atop a padding layer formed of one or more foam blocking panels (e.g., high-density microcellular polyurethane foam), plus a soft foam pad or woven fabric underlayment against the skin. In addition, the sports guard is attached in a unique manner. Rather than two opposing straps that wrap around and come together, the invention on a single wrap-around (360 degree plus) strap that is attached at a single point to itself in a full self-contained manner. The greater than 360 degree strap of the disclosure seats in channels and works to secure the sports guard for proper hold: the sides of the sports guard compressing inward as a result of the 360+ compression fit resulting in a firmer hold around the limb and more secure retention.

For purposes of illustration the invention and its various features are herein described in the context of a protective shin guard that employs a particular flex-padding configuration with a floating knee section attached to a shin section. Both knee and shin sections are formed of multiple layers including a hard shell outer layer with multiple articulated panels attached atop a padding layer formed of one or more foam blocking panels (e.g., high-density microcellular polyurethane foam), plus a soft foam pad or woven fabric underlayment against the skin. In one embodiment, the hard shell outer panel(s) of the shin section includes a central Y-shaped shin bone panel and flanking side leg panels pivotally joined to the shin bone panel at hinges. The shin guard is attached to the leg by a combination of straps including a calf-strap and behind-the-knee strap. The calf-strap is a compound Y-shaped elastic strap, and the knee strap is a 360 degree compression strap, preferably elastic, that wraps fully around the leg and works in conjunction with the side leg panels to pull them in from all sides for a secure compression fit.

The side leg panels may be pivotally joined to the central shin bone panel at flexible joints formed by any one of living hinges, sewn joints, or by attachment of the side leg panels to the underlying padding layer (e.g., "under attachment").

Where the hinges are living hinges the entire hard shell outer layer of the shin section is integrally molded but the side leg panels are separated from the central shin bone panel by bridge areas of reduced material thickness in the bard shell which allows the side panels to rotate and move with respect to the shin bone panel.

Where the hinges are sewn-in, the central shin bone panel is overlaid atop the side panels along a margin of overlap, and the overlying panels are sewn together along the overlap margin, thereby forming a flexible joint.

Where the hinges are under attached, the shin bone panel is formed from the hard shell outer section, and the flanking side leg panels are integrally-attached to the underlying padding layer. The resiliency of the foam padding layer gives the side leg panels inherent flex.

In all cases the degree of flex at the joints may be controlled and/or constrained by pliable transition inserts that resist flexing. These pliable transition inserts are elastomeric beads that partially fill the joints, or strips overlying or underlying the joints, or inserts sandwiched between the overlapping sections at the joints to resist or constrain flexure at the joint. The pliable transition inserts may be high-density (HD) foam.

In all embodiments the unique pattern of flexible hinges works in combination with a 360+ degree strap system to yield a protective shin guard with more flexibility, more protection, and a steadfast compression fit that will not shift or come loose during play.

Figure 2:
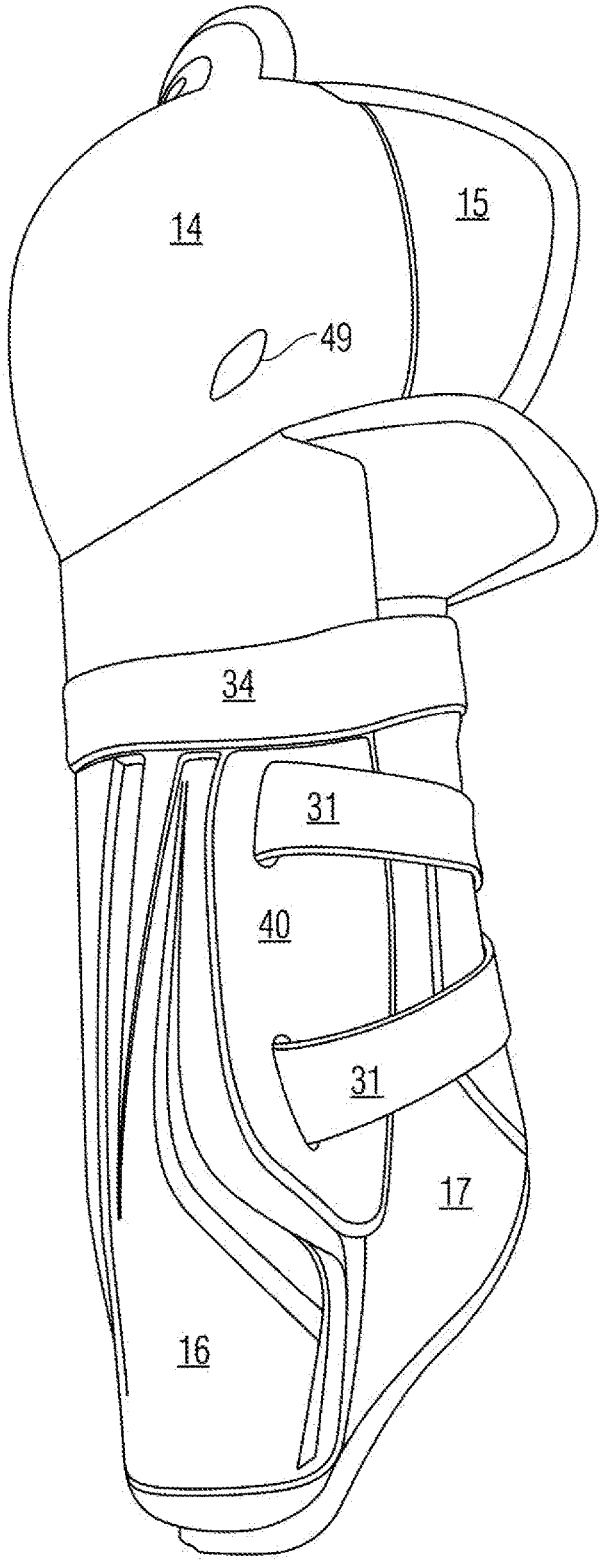
FIG. 2 is a left-side perspective view of the protective shin guard 2 of FIG. 1.
Figure 3:
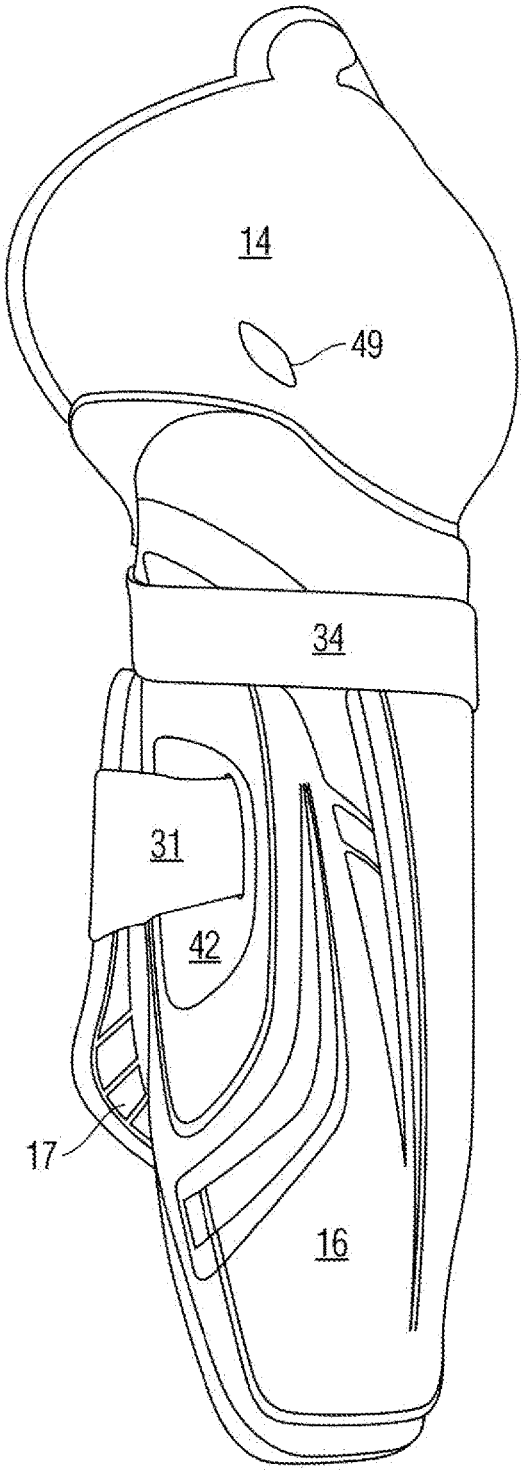
FIG. 3 is a right-side perspective illustration of the protective shin guard 2 of FIG. 1.

Referring to FIGS. 1-3, a first embodiment of a protective shin guard 2 of the type worn to play ice-hockey is shown, according to the invention. The protective shin guard 2 generally comprises a floating knee section 4 and a slim section 6 connected to one another. The connection between the floating knee section 4 and shin section 6 may be by a fabric liner, pins, flexible hinges, or may be in any other suitable manner. The shin section 6 is trough-shaped adapted to conform to the leg of the wearer, with a generally arcuate cross-section profile. The knee section 4 is generally concave and conforms to the knee. Both knee and shin sections 4, 6 are formed from rigid and padded layers, including a hard shell outer layer 10 (see FIG. 1 inset) attached atop a non-rigid layer 20 preferably formed of one or more foam blocking panels, plus a soft foam or woven fabric comfort pad 30 underlayment against the skin. For the shin section 6 the hard outer shell 10 comprises at least two articulated panel(s) 16, 17 made from, for example, an impact resistant plastic such as nylon or polycarbonate. Three panels are preferred, including a center shin bone panel 16 and flanking side panels 17 (left and right) attached to the central shin bone panel 16 along flexible joints. As stated above the flexible joints may be living hinges 28 (top inset), sewn-in hinges 29 (bottom inset), or underlayments (described below) to allow the side panels 17 to rotate and move with respect to the shin bone panel 16.

Optionally, the shin section 6 comprises at least one and preferably two pliable inset(s) 40, 42 as will be described to resist and/or constrain flexing of side panels 17 relative to the shin bone panel 16.

For the knee section 4 the hard outer shell 10 comprises a single sculpted panel 14 with an optional anterior hinged panel 15 (see FIG. 2). The hard shell outer panel(s) 14, 16 (and optionally 15, 17) of both knee and shin sections 4, 6 overlie the non-rigid padding layer 20, which in the preferred embodiment is a layer of compressible foam (e.g., high-density microcellular polyurethane foam), but may be other suitable material (e.g., elastomer or woven). Padding layer 20 may be of uniform thickness or may include multiple blocking panels. A comfort pad 30 comprising a woven fabric liner or soft foam pad underlayment is attached beneath the foam blocking panel(s) 22 for skin contact. The comfort pad 30 is preferably attached by hook-and-loop so as to be fully removable and washable. The hard shell outer panel(s) of the shin section 6 and or knee section 4 may include one or more pass-through vents 49 into the padding layer 20 for air circulation.

The hard shell panels of shin section 6 may include a central X- or Y-shaped shin bone panel 16 and one or two flanking side leg panels 17. In the top inset of FIG. 1 (A) the shin bone panel 16 and flanking side leg panels 17 are all integrally-formed but substantially separated by a pair of opposing notches 28 that delineate three panels 16-17, except at selected bridge areas of reduced material thickness (see FIG. 1 inset). These bridge areas effectively form living hinges 28 which add flexibility, allowing the side panels 17 to rotate and move with respect to the shin bone panel 16. A pair of living hinges 26 bridges each side panel 17 of the shin guard 2 joining them to the central shin bone panel 16. Specifically, on the right side a first living hinge 28 of reduced material thickness can extend from the upper corner of the outer side panel 17 to the shin bone panel 16, and continue to approximately midway down the outer side panel 17. Likewise, on the left side a second living hinge 28 of reduced material thickness can extend from the upper corner of the inner side panel 18 to the shin bone panel 16, and continue to approximately midway down the inner side panel 18. One skilled in the art will understand that additional living hinges may be added for more stability as a matter of design choice. Thus, for example, a living hinge 28 may be positioned at each of the upper and lower corners of the inner and outer side panels 17 giving four total hinges to the central shin bone panel 16.

One skilled in the art will understand that living hinges 28 may be replaced by overlapping sewn hinges 29 as seen in the bottom inset of FIG. 1 (B). In this case, the central shin bone panel 16 and flanking side leg panels 17 overlap slightly and are sewn together along the overlap to form a flexible joint or seam.

As described below, the shin guard 2 is attached to the leg by one or more straps, at least one of which is a 360+ degree compression strap 34 that wraps fully around the leg at least 360 degrees and works in conjunction with the side panels 17 to pull them in from all sides, offering a more comfortable yet secure compression fit. The living hinges 28 on both outside and inside side panels 17 allow the guard and 360+ degree strap 34 to compress inward from the sides, front and back allowing for a 360 compression hold around the leg for a more secure retention.

The padded layer 20 of compressible foam blocking panel(s) 22 may be open or closed-cell foam. The open- or closed-cell padded layer 20 helps to cushion against blows but tends to transfer impact to a localized area of the shin. The hard shell outer panel(s) 10 of both knee and shin sections 4, 6 help to dissipate the force of an impact by maintaining a rigid structure or cracking under a large applied force. For knee section 4 the padded layer 20 is continuous underneath the entire outer shell 10, and both layers 10, 20 are of substantially uniform thickness. The same may be true for the shin section 6. However, in another embodiment described below the hinged panels may be formed in the foam padded layer 20, not the hard outer shell layer 10, in which case pliable transition inserts are sandwiched between the hard shell outer section and padding layer to control or constrain flexibility.

In accordance with the embodiment of FIGS. 1-3, the flexible joints (living hinges 28 or seams 29) are configured to permit flexure both laterally and backward. Optionally, one or more pliable inserts 40, 42 may be included. For living hinges 28 the pliable inserts 40, 42 may be fitted inside the notches 28 of the hard outer shell 16 of the shin section 6. The pliable inserts 40, 42 comprise any suitable pliable material, in this case bonded or adhered to the side panels 17 and configured to extend into and fill the notches 28, thereby permitting flexure both forward and backward yet imparting a pre-bias against forward flexure. Pliable inserts 40, 42 add the ability to control and/or constrain the flexing of side panels 17 and their motion with respect to the central shin panel 16. Alternatively, the pliable inserts 40, 42 may be sandwiched beneath the hard outer shell 16 of the shin section 6 and the underlying padded layer 20, bridging the living hinges 28, or as described below for sewn hinges 29 (FIG. 6) they may be sandwiched between the overlapping side sections 17 and central shin bone section 16. In all such cases pliable inserts 40 permit flexure both laterally and backward, yet resisting forward flexure. There may be one or more flexible joints on each side of the X- or Y-shaped shin bone panel 16, and there may be one or more pliable inserts 40, 42 on each side of the shin bone panel 16. This particular flexible joint 28, 29 pattern with or without pliable inserts 40, 42 provides needed 'compression' around the sides and back of the leg for better fit and stability without sacrificing 'structure' and 'deflection'.

Rotational shifting (up/down front/back) as well as crease/seam flexing and collapsing is a negative effect because it impedes the ability to deflect impacts away from the leg (shin bone) efficiently. Flexible joints such as hinges 28 help to prevent this, constraining side panels 17 to articulate inward on a vertical axis (knee to ankle) from the shin bone back, yet preventing rotational shifting of side panels or collapsing at the seam (between front panel and sides). Sewn hinges 29 serve the same purpose, the overlap inherently preventing rotational shifting of side panels or collapsing at the seam (between front panel and sides). The use of pliable inserts 40, 42 also helps, the net effect being that the central X/Y-shaped shin bone panel 16 and flanking side leg panels 17 seem connected as 'one structure' rather than a loose assemblage of hinged panels.

Figures 4, 5:
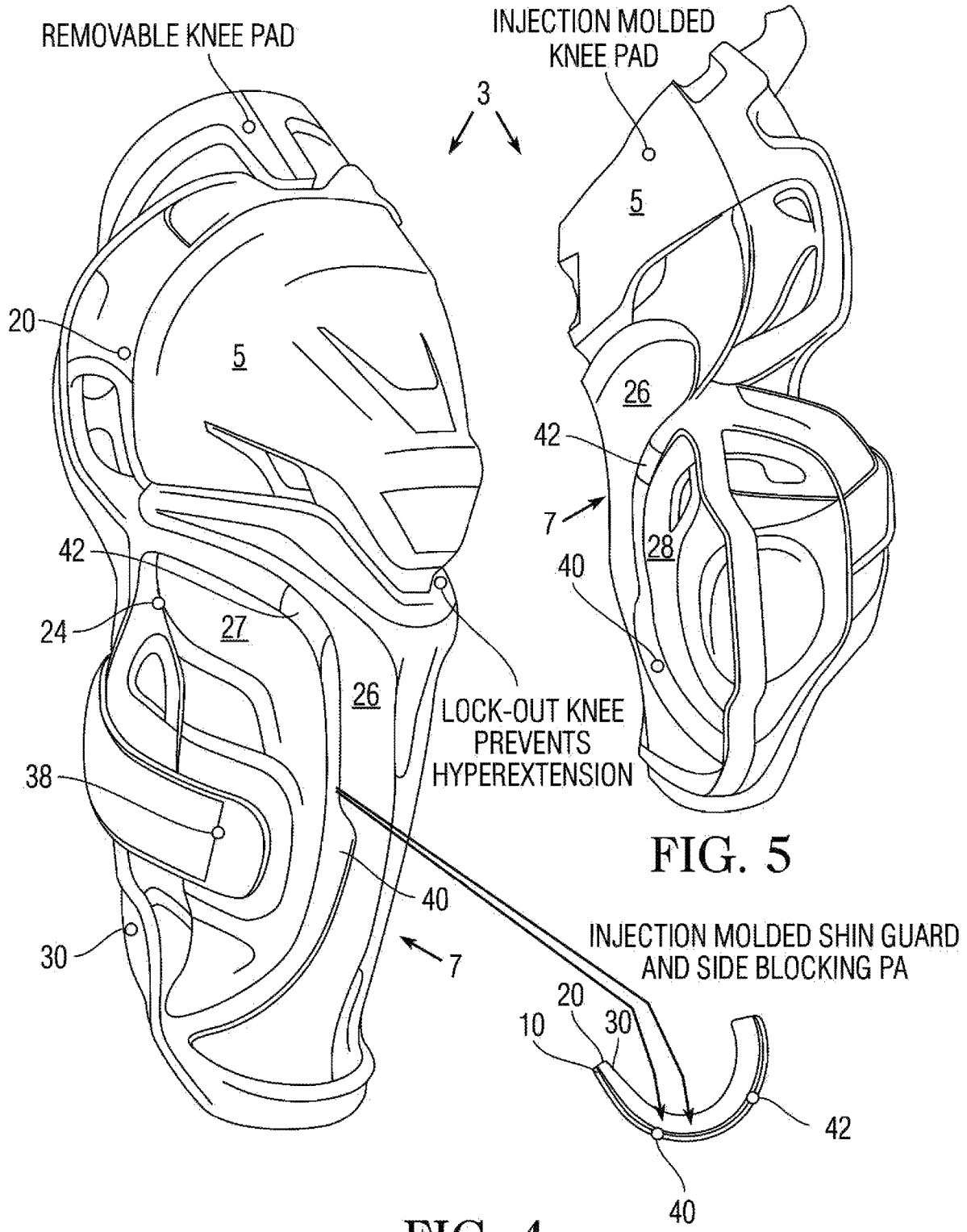
FIG. 4 is a right-side perspective illustration of a protective shin guard 20 in accordance with another embodiment of the present invention.
FIG. 5 is a left-side perspective illustration of the protective shin guard 20 of FIG. 4.

Still other flexible joint configurations are possible. For example, in another embodiment shown in FIGS. 4-5, the flexible joints are of the "underlayment" type. Here the protective shin guard 3 includes a floating knee section 5 attached to a shin section 7, both sections again being formed of multiple layers including a hard shell outer layer with multiple articulated panels attached atop a non-rigid padding layer 20 formed of one or more blocking panels of compressible foam, plus a soft foam comfort pad 30 or woven fabric underlayment against the skin.

The hard shell outer layer 10 of the shin section 7 includes just the central Y-shaped shin bone panel 26. Flanking side leg panels 27, 28 are integrally attached, adhered or formed in the underlying padding layer 20. The hard shell outer panels 5, 26 of both sections are seated flush against the underlying foam padding layer 20 such that the padding layer 20 forms a framework, extending a margin around the flush-seated hard outer shells 14, 16. This margin gives a smooth transition into panels 5, 26 for smooth integrated protection, and provides a more sculpted and tapered look.

The non-rigid framework of padding layer 20 results in side leg panels 27, 28 having more flexibility, such that the shin guard will flex horizontally and, when tightened with the same 360+ degree compression strap 34 described above, fit snuggly around a user's leg.

In this second embodiment, the shin bone panel 26 and flanking side leg panels 27, 28 may again be optionally transitioned together by pliable inserts 40, 42 which add the ability to control and/or constrain the flexing of side panels 27, 28 and their motion with respect to the shin bone panel 26. Specifically, on each side a first pliable transition insert 40 extends from a proximate lower corner of the outer side panel 27 to the shin bone panel upward along the center shin bone panel 26. A second pliable transition insert 42 extends from a proximate upper right corner of the inner side panel 28 toward the center shin bone panel 26, a short distance down along the center shin bone panel 26.

Figure 6:
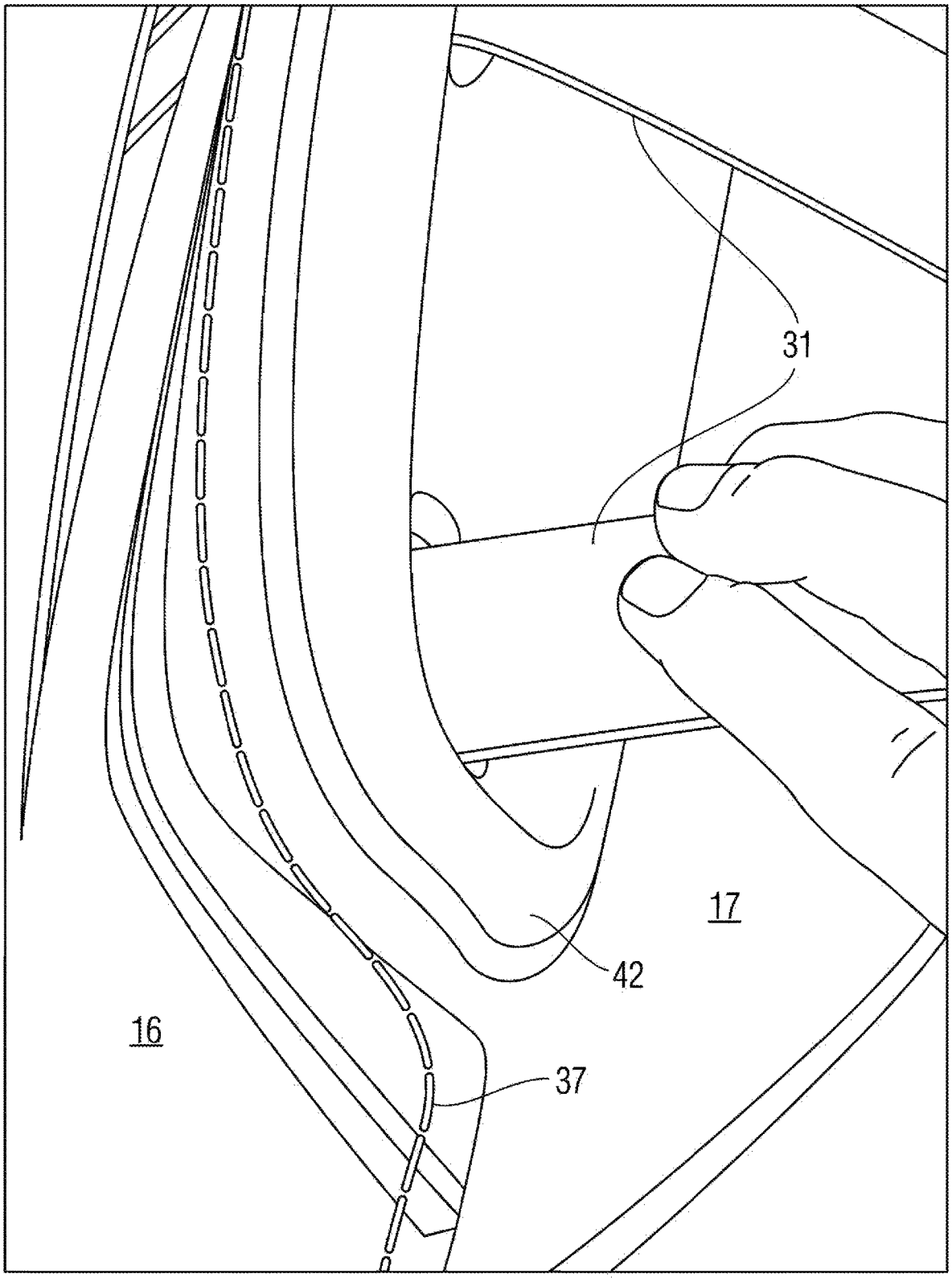
FIG. 6 is a dose-up photo of an exemplary transition insert 42.

FIG. 6 is a close-up photo, of an exemplary pliable transition insert 42 adhered or bonded to a side section 17 and partially-sandwiched between hard shell central shin section 16 and side section 17 at the sewn joint 37. The pliable inserts 40, 42 add the ability to control and/or constrain the flexing of side panels 17. They are sandwiched between the overlapping central panel 16 and side panels 17 to damp the transition. Specifically, on each side a first pliable transition insert 40 extends from a proximate lower corner of the outer side panel 17 to the central shin bone panel 16 upward along the center shin bone panel 16. A second pliable transition insert 42 extends from a proximate upper right corner of the inner side panel 17 toward the center shin bone panel 16, a short distance down along the center shin bone panel 16. The transition inserts 40, 42 may be any suitable pliable material but are most preferably a high-density urethane foam (HD foam), bonded or adhered to the side panels 17 and protruding into the stitched seam of the overlapping central shin bone panel 16 and side panels 16.

One transition insert 40 is located on the left side of hard shell central shin section 16, and one 42 on the right side as described above. The transition inserts 40, 42 may optionally be sewn to the underlying padding layer 28 by the seam 37 as shown, but in all cases are partially sandwiched beneath the overlapping hard shell sections 16, 17. If desired, the fixedly-attached ends of a calf-strap 31 (described below) may be attached beneath one of the two transition inserts 40, 42 and emerge through it though port(s) molded into the foam. The side panels 17 (or 27, 28 in FIGS. 4-5) are not likely to experience the high impacts seen by the frontal shin bone panels 16, 26, and the use of pliable inserts 40, 42 capitalizes on this to provide a reduction in weight with similar performance characteristics and absorption/deflection qualities. They also allow greater flexibility around leg/calf, such that a more secure fit can be obtained using the pliable inserts 40, 42 versus living hinges as described above. The material qualities of the transition inserts 40, 42 and their thickness control the degree of flex. Moreover, the thickness of the transition inserts 40, 42 can be varied to constrain the hinge action of side panels 17, 27, 28. For example, by fitting a transition insert 40, 42 into an alcove in hard shell shin section 26 using a tongue-and-groove fit as shown in FIG. 1 inset, or in a sandwich configuration as seen in FIG. 6, the range of pivoting motion of the respective side panels 17, 28 are constrained. If side panels, 17, 28 flexes an unusual degree outward the edge of transition insert 42 will become compressed under the edge of hard shell shin section 17, 26 thereby limiting and constraining further flex.

Similarly, and referring back to FIGS. 4-5, the hard shell knee panel 5 is molded with a recess into which the top of the X/Y-shaped shin bone panel 26 fits. The dimensions of the recess can be varied to impose a counter-rotation stop-limit on the shin section 7, thereby providing a lock-out knee feature that prevents hyper-extension.

With reference to FIG. 7 all the above-described embodiments of the protective shin guard 2, 3 include a combination of straps including a compound calf-strap 31 and novel 360+ degree compression strap 34 for behind-the-knee. The calf-strap 31 is a compound Y- or V-shaped strap preferably formed of an elastic material such as, for example, neoprene or the like. The calf-strap 31 is Y- or V-shaped shaped with two attachment legs 32, 33 fixedly attached on one side of the shin guard 2 and converging to a single removable leg on the other side of the shin guard 2, the latter bearing a hook-and-loop attachment pad 35 for securement over-the-shin. The Y- or V-shaped elastic over-the-shin configuration helps keep the shin guard centered. In addition, the strapping includes one elastic or inelastic 360+ degree compression strap 34 for behind-the-knee/above-the-shin fixation that wraps fully around the leg, at least 360 degrees (360+) and attaches onto itself. When contrasted with conventional strap-pairs that attach around back, the 360+ degree compression strap 34 works better in conjunction with the side leg panel(s) 17, 27, 28 to pull them in from all sides for a secure compression fit. The 360+ compression strap 34 is an approximately 2 foot long section of material fixedly attached on one side of the shin guard 2 preferably on an upper corner of one of the side panels, 17, 18 or 27, 28 of the shin sections 6, 7 of shin guards 2, 3. The 360+ compression strap 34 extends at about a 45 degree angle upward and outward from the upper corner of the side panel. A distal attachment pad 38 is mounted on the end of 360+ compression strap 34, with inwardly-facing hook material and an outwardly tacky rubberized surface to serve as a pull-tab. The entire outwardly-facing back surface of 360+ compression strap 34 (except for attachment pad 38) bears opposing loop material.

Optionally, one or both straps 31, 34 may have a rubberized grip material 39 inlayed or coated onto, and extending along the inner surface of the strap(s) 31, 34 (see FIG. 1). The rubberized grip material 39 may be any suitable silicon or rubberized fabric material sewn thereto or coating applied thereon to provide a higher degree of friction against the underlying surface to which it is affixed. This is especially effective when the calf-strap 31 overlies the HD foam inserts 40, 42, and when the behind-the-knee 360+ degree compression strap is positioned within defined retention channels 47 described below.

FIG. 7 is a composite step-by-step illustration of the process for affixing the shin guard 2, 3 to the leg using the compound calf-strap 31 and behind-the-knee 360+ compression strap 34. At step (1), the shin guard 2, 3 is placed in position and is initially secured in place by calf-strap 31, pulling the calf-strap 31 around behind the shin. The Y- or V-shaped attachment legs 32, 33 center the shin guard 2 over the calf, and converge to attachment pad 35 for single point securement over-the-shin. This done, the player pulls the 360+ compression strap 34 back and wraps it around the top of the calf, moving from outside, back and around inside to the front of the shin guard 2. At step (2) the player pulls tight on 360+ compression strap 34. At step (3) the player continues to pull the 360+ compression strap 34 around front of the leg to the anchor point at the start of the strap 34. At step (4) the player continues wrapping around back of their calf and inside the calf.

At this point the 360+ compression strap 34 has made a greater than 360 degree rotation around the shin guard 2, 3. At step (5) they fit to a comfortable tension and at step (6) the distal attachment pad 38 is then secured to the medial attachment pad 34 to secure the shin guard 2 in place. Importantly, the 360+ compression strap 34 cannot be fastened until the player first wraps it more than 360 degrees around the leg. Only past this point may the inwardly-facing hook material of distal attachment pad 38 be secured to the outwardly facing loop material on the back surface of 360+ compression strap 34 to secure the strap 34 for proper hold. The hinged outside and inside leg panels 17, 18, or 27, 28 compress inward from the sides as a result of the 360+ compression strap 34, resulting in a firmer hold around the leg and more secure retention.

To further facilitate application and retention of the 360+ compression strap 34, the central Y-shaped shin bone panel 16 and/or two flanking side leg panels 17 may be formed with a recessed retention channel 4 within which the 360+ compression strap 34 fits for maximum tightness and to help it stay in place despite impact and abrasion.

Figure 8:
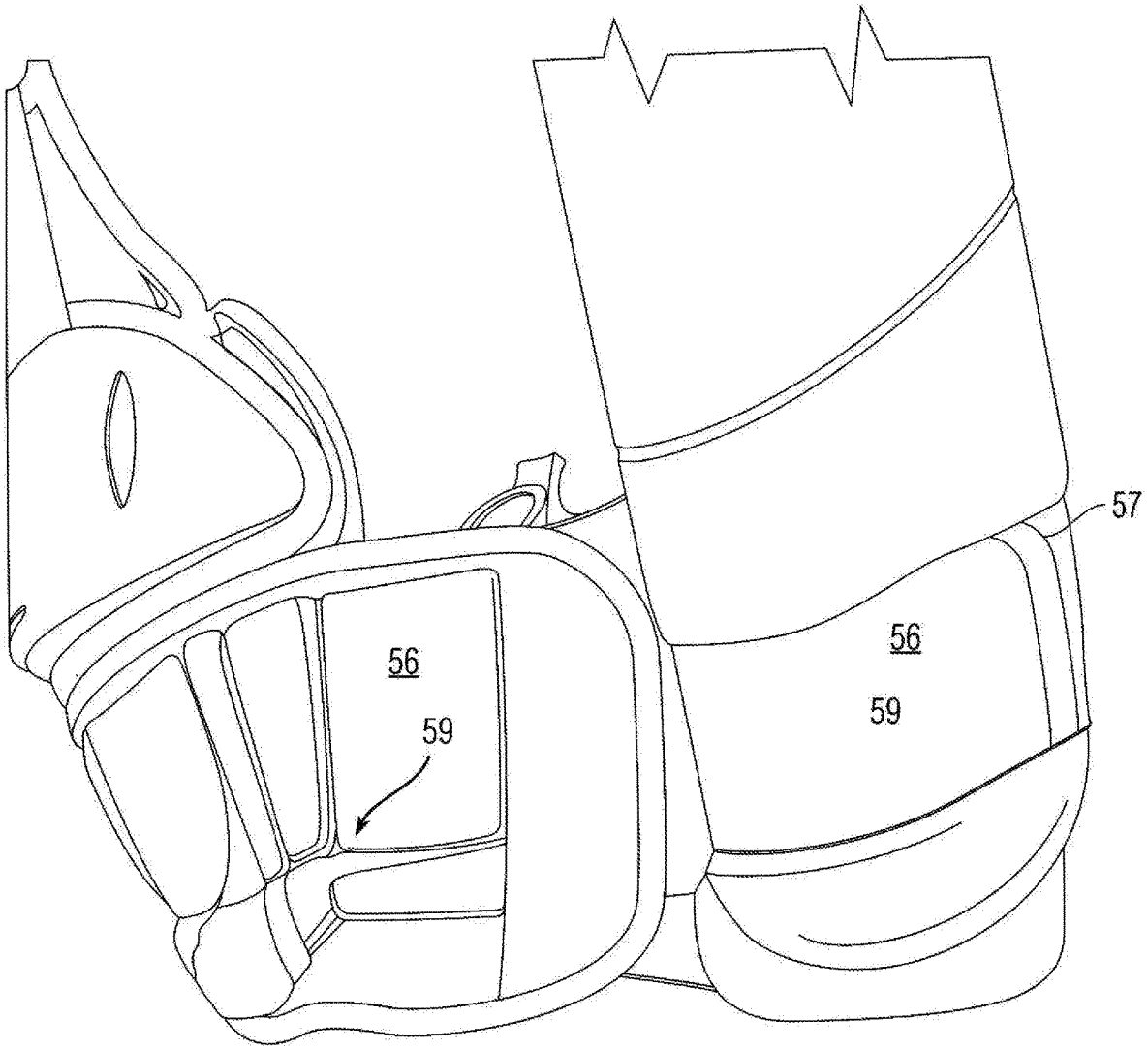
FIG. 8 is an enlarged perspective illustration of two retention channels 59 in the context of the exemplary arm guard of FIG. 9.
Figure 9:
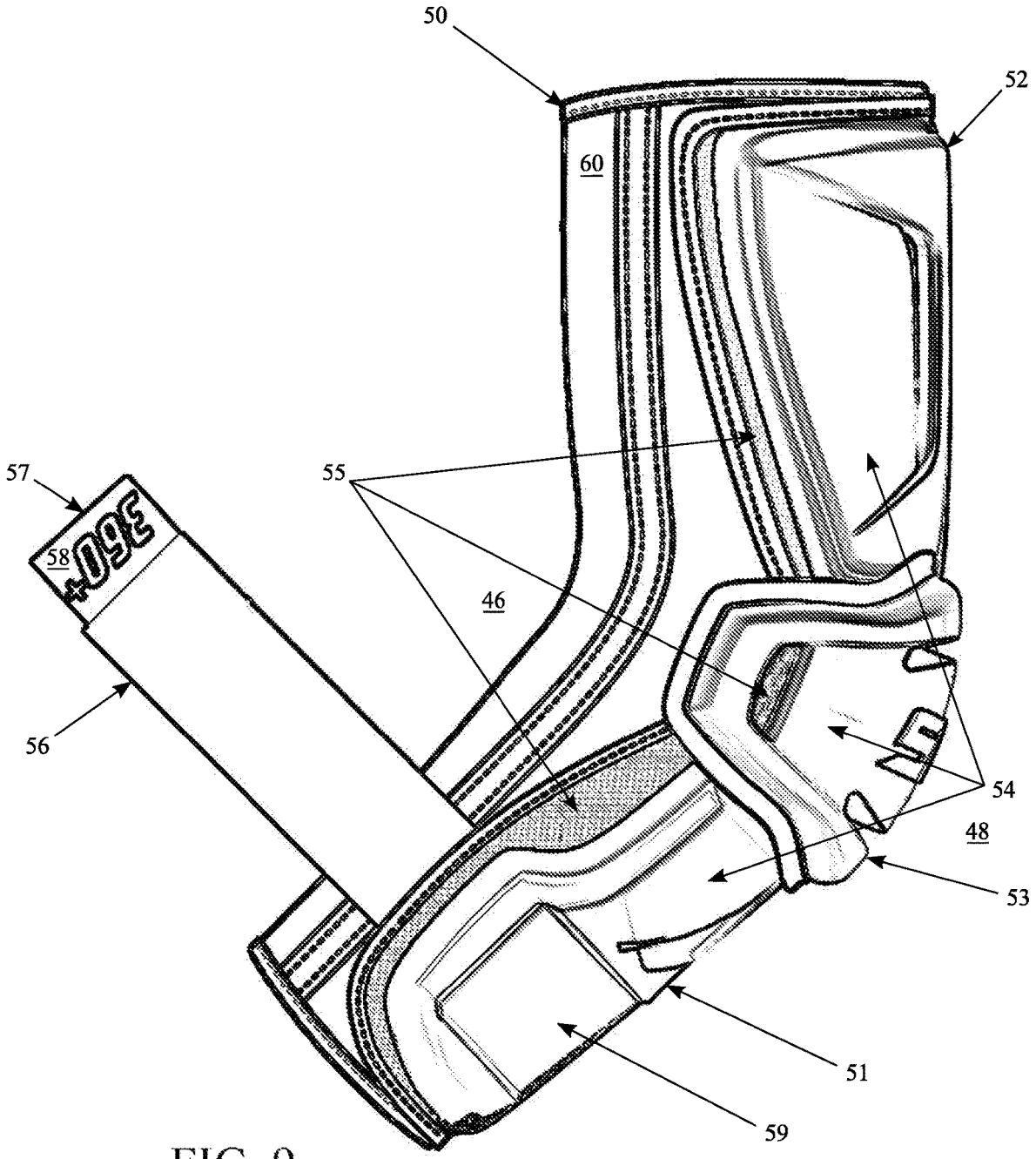
FIG. 9 is a perspective side view of a protective arm guard in accordance with an embodiment of this disclosure, also shown in FIG. 8.

FIG. 8 is an enlarged perspective illustration of two retention channels 59 in the context of the protective arm guard 50 of FIG. 9. A retention channel may be defined by cutting and sewing foam and/or by integrally molding plastic. In both cases the channel 59 height should be at least twice the thickness of the strap 34 so that when the strap 34 makes its 360+ degree rotation wrap around the shin guard 2, 3 it seats flush where doubled up. The retention channels 59 may be single-sided as shown at left (defining one upper bounded wall) or two sided as shown at right (defining two bounding walls).

The particular pattern of hard outer shell 10 and non-rigid inner padding 20, with flexible hinges or inserts and strap system with at least one 360+ compression strap 34 combine to provide maximum protection to the user's shin and knee while maintaining as much flexibility as possible.

FIG. 9 is a perspective side view of a protective arm guard 50 in accordance with an embodiment of this disclosure, also shown in FIG. 8. The protective sports guard 50 can include a lower component 51, such as a forearm section; an upper component 52, such as an upper-arm section; and a central component 53, such as an elbow guard or a floating elbow section. The central component 53 can be attached to and straddle the lower component 51 and the upper component 50. Components of the protective sports guard 50 can be attached to each other using any attachment mechanism suitable for the purposes of this disclosure, such as flexible hinges. Protective sports guard 50 can include a generally inner side 46 and outer side 48.

According to embodiments of this disclosure the lower component 51, upper component 50, and/or central component 53 can each include a hard shell outer layer 54 attached atop another layer, such as a flexible padding layer 55. The flexible padding layer 55 forms a flexible but rigid blocking panel and may provide an underlayment against the skin of a human body part, such as a forearm, upper-arm, or elbow. Toward this end the flexible padding layer is preferably a thin sheet of resilient plastic of a durometer less than that of hard shell outer layer 54, such that it remains relatively pliable and can be furled inward around the wearer's forearm. If the flexible padding layer 55 will abut the skin then a woven fabric shell as shown provides a breathable more comfortable underlayment against the skin.

In some embodiments, the lower component 51, upper component 50, and/or central component 53 may additionally include a soft comfort pad layer beneath flexible padding layer 55. The soft comfort pad layer can be any soft foam or woven fabric comfort pad underlayment against the skin.

According to embodiments of this disclosure, components of the protective sports guard 50 can extend around some or all of a human body part, and various layers and panels of components of the protective sports guard 50 can extend relative to other layers and panels of components of the protective sports guard 50. For example, the upper component 50 can extend around greater than or less than 180 degrees of an upper arm of a human and/or the lower component 51 can extend around greater than or less than 180 degrees of a lower arm of a human. In some embodiments, the flexible padding layer 55 of a component can contribute to the extension of the component by flaring out on one or more sides of the hard shell outer layer 54 of the component. For example as shown in FIG. 9, the lower component 51 can be configured to extend around a lower arm of a human and the flexible padding layer 55 of the lower component 51 can extend further around the lower arm than the hard shell outer layer 54 of the lower component 51. As another example, the upper component 50 can be configured to extend around an upper arm of a human and the flexible padding layer 55 of the upper component 50 can extend further around the upper arm than the hard shell outer layer 54 of the upper component 50. In some embodiments, the flared out portions of the flexible padding layer 55 can define side blocking panels. The flexible padding layer 55 of the upper component 50, central component 53, and lower component 51 can be formed from a variety of materials suitable for the purposes of this disclosure. For example, the flexible padding layer 55 of the lower component 51 and the upper component 50 can be formed from microcellular polyurethane foam encased in a woven fabric shell.

In some embodiments of this disclosure, the protective sports guard 50 can include a strap for securing components of the protective sports guard 50 to a human body part. For example, the protective sports guard 50 can include an elongate first strap 56 fixedly attached at one end, such as a near end of the first strap 56, to a component of the protective arm guard, such as to the flexible padding layer 55 of the lower component 51. The first strap 56 can be releasably and variably attached to itself at another end of the first strap 56, such as a distal end 57 of the first strap 56. The first strap 56 can include an attachment pad 58 at an end of the first strap 56, such as a distal attachment pad attached at the distal end 57 of the first strap 56. In some embodiments, first strap 56 can include an inwardly-facing hook material and an outwardly tacky rubberized surface to serve as a pull-tab. An inner surface of the first strap 56 can also include other materials, such as a grip material 39 discussed above. The first strap 56 can be partially elasticized, and whether or not elastic is configured to wrap more than 360 degrees around the entire lower component 51 of the protective sports guard 50 and then releasably and variably attached to itself in one full loop.

Most preferably, the first strap 56 is be configured to wrap around the lower component 51 and wearer's limb in excess of one full revolution and to envelop and compress a human body part for a compression fit. In such embodiments the first strap 56 can be considered a "360+ compression strap." The compression fit can include the compression around a human body part of the flexible padding layer 55, hard shell outer layer 54, and/or other layers or panels of a component of the protective sports guard 50. The compression fit can pull such layers and panels in from all sides, offering a more comfortable yet secure fit.

The hard shell outer layer 54 of the protective sports guard 50 includes formations that seat the first strap to help secure the protective sports guard 50 to a human body part, according to embodiments of this disclosure. For example the hard shall outer layer 54 of the lower component 51 can be molded with a recessed retention channel 59 fully or partially traversing the hard shall outer layer 54 of the lower component 51, thereby providing indexed seating for the first strap 56. The retention channel can be oriented in a variety of directions. For example, as shown in FIG. 9, the retention channel can be oriented substantially transverse to the lower component 51. Alternatively or in conjunction with a retention channel 59, multiple retention members 57 resembling belt loops made of a variety of suitable fabric material can be sewn to the other layers or panels or otherwise conventionally attached to retain the first strap 56 and help secure the protective sports guard 50 to a human body part. Referring back to FIG. 8, an example of a suitable retention member 57 is shown. The combination of the first strap 56 with the layers and/or panels of components of the protective sports guard 50 can provide maximum protection to a user's upper arm, lower arm, or elbow, while maintaining as much flexibility as possible.

Some embodiments of this disclosure can optionally include additional components for compressing the protective sports guard 50 around a human body part. For example, a second strap can be fixedly attached to a component of the protective sports guard 50, such as the upper component 50, at one or more ends of the second strap. As an example, the second strap can be elongate and releasably and variable attached at an end to itself, or the second strap can be compressible and form a loop for fitting around a human body part, with each end of the second strap fixedly attached to a component of the protective sports guard 50. For example, the second strap can extend around the human body part, such as the upper arm. In some embodiments a sleeve 60 can be integrated with and/or fixedly attached to at least one of the upper component 50, lower component 51, and central component 53 of the protective sports guard 50.

It should now be apparent that the above-described protective sports guard allows a user freedom of movement, especially in a lacrosse or hockey scenario, yet maximum protection and secure fit.

The foregoing disclosure of embodiments of the present invention has been presented for purposes of illustration and description. It is not intended to be exhaustive or to limit the invention to the precise forms disclosed. Many variations and modifications of the embodiments described herein will be obvious to one of ordinary skill in the art in light of the above disclosure. The scope of the invention is to be defined only by the claims, and by their equivalents.

What is claimed is:

1. A protective sports guard, comprising:

a lower component comprising a hard shell outer layer attached atop a flexible padding layer;

an upper component comprising a hard shell outer layer attached atop a flexible padding layer;

a central component attached to and straddling said lower component and said upper component and comprising a hard shell outer layer; and an elongate first strap fixedly attached at one end to the flexible padding layer of said lower component, releasably and variably attached at another end to itself, and configured to wrap around said lower component in excess of one full revolution for enveloping and compressing a human body part for a compression fit.

2. The protective sports guard of claim 1, further comprising a soft comfort pad attached beneath at least one selected from the group consisting of: the flexible padding layer of said upper component and the flexible padding layer of said lower component.

3. The protective sports guard of claim 1, further comprising a flexible padding layer attached beneath said hard shell outer layer of said central component.

4. The protective sports guard of claim 3, further comprising a soft comfort pad attached beneath said flexible padding layer of said central component.

5. The protective sports guard of claim 1, wherein said first strap comprises a distal attachment pad.

6. The protective sports guard of claim 1, wherein said human body part comprises a lower arm.

7. The protective sports guard of claim 1, further comprising a recessed retention channel formed in the hard shell outer layer of said lower component and oriented to seat said first strap.

8. The protective sports guard of claim 1, wherein an inner surface of said first strap comprises a grip material.

9. The protective sports guard of claim 1, wherein said upper component is configured to extend around at least 180 degrees of an upper arm of a human.

10. The protective sports guard of claim 1, wherein said lower component is configured to extend around at least 180 degrees of a lower arm of a human.

11. The protective sports guard of claim 1, wherein said lower component is configured to extend around a lower arm of a human and the flexible padding layer of said lower component extends further around said lower arm than the hard shell outer layer of said lower component.

12. The protective sports guard of claim 1, wherein said upper component is configured to extend around an upper arm of a human and the flexible padding layer of said upper component extends further around said upper arm than the hard shell outer layer of said upper component.

13. The protective sports guard of claim 1, wherein said central component comprises an elbow guard.

14. The protective sports guard of claim 1, wherein said central component overlaps an outer surface of at least one selected from the group consisting of: said upper component and said lower component.

15. The protective sports guard of claim 1, further comprising a sleeve fixedly attached to at least one selected from the group consisting of: said lower component, said central component, and said upper component.

16. The protective sports guard of claim 1, wherein the flexible padding layer of said lower component and said upper component comprises microcellular polyurethane foam encased in a woven fabric shell.

* * * * *